US008449059B2

(12) United States Patent
Yamashita

(10) Patent No.: US 8,449,059 B2
(45) Date of Patent: May 28, 2013

(54) LIQUID EJECTING APPARATUS

(75) Inventor: Noriaki Yamashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 69 days.

(21) Appl. No.: 13/249,011

(22) Filed: Sep. 29, 2011

(65) Prior Publication Data

US 2012/0081431 A1 Apr. 5, 2012

(30) Foreign Application Priority Data

Oct. 1, 2010 (JP) ..... 2010-223579

(51) Int. Cl.
*B41J 29/38* (2006.01)
*B41J 2/045* (2006.01)

(52) U.S. Cl.
CPC ..... *B41J 2/04596* (2013.01)
USPC ..... 347/11; 347/10

(58) Field of Classification Search
USPC ..... 347/10, 11
See application file for complete search history.

(56) References Cited

U.S. PATENT DOCUMENTS

2005/0030326 A1* 2/2005 Berger et al. ..... 347/10

FOREIGN PATENT DOCUMENTS

| | | | |
|---|---|---|---|
| JP | 2002-113858 | A | 4/2002 |
| JP | 2005-280199 | A | 10/2005 |
| JP | 2007-083737 | A | 4/2007 |

* cited by examiner

*Primary Examiner* — Julian Huffman
(74) *Attorney, Agent, or Firm* — Kilpatrick Townsend & Stockton LLP

(57) ABSTRACT

A piezoelectric vibrator varies the pressure in a pressure chamber in accordance with a drive signal, whereby ink contained in the pressure chamber is ejected from a nozzle. The drive signal includes a slight-vibration pulse used to change the pressure in the pressure chamber to an extent that the ink is not ejected. The slight-vibration pulse includes a first changing component in which the potential changes from a reference potential in a negative direction in which the pressure in the pressure chamber is increased by the piezoelectric vibrator, a second changing component which is generated to follow the first changing component and in which the potential changes so as to cross the reference potential in a positive direction, and a third changing component which is generated to follow the second changing component and in which the potential changes to the reference potential in the negative direction.

6 Claims, 7 Drawing Sheets

LIQUID EJECTING APPARATUS

BACKGROUND

1. Technical Field

The present invention relates to techniques for ejecting liquid, such as ink.

2. Related Art

Hitherto, liquid ejection techniques have been proposed, in which liquid (e.g., ink) contained in a pressure chamber is ejected from a nozzle by changing the pressure in the pressure chamber using a pressure generating element, such as a piezoelectric vibrator or a heating element. In the liquid ejection techniques, a configuration is employed, in which, from the viewpoint of realization of stable ejection by reducing an increase in the viscosity of liquid contained in a pressure chamber, the liquid is appropriately stirred by providing a slight vibration to an extent that the liquid is not ejected. A slight vibration is generated in the pressure chamber by supplying a slight-vibration pulse to a pressure generating element.

JP-A-2002-113858 discloses a slight-vibration pulse QA having a waveform shown in FIG. 10. The slight-vibration pulse QA shown in FIG. 10 is generated as a trapezoidal-shaped pulse including a first changing component Ea1 in which the potential changes in a direction in which the pressure in a pressure chamber is reduced (in a direction in which the pressure chamber is expanded), a holding component Ea2 in which a potential of an end of the first changing component Ea1 is held, and a second changing component Ea3 in which the potential changes in a direction in which the pressure in the pressure chamber is increased (the pressure is reduced and then increased).

Furthermore, JP-A-2005-280199 discloses a slight-vibration pulse QB having a waveform shown in FIG. 11. The slight-vibration pulse QB shown in FIG. 11 is configured so as to include a first changing component Eb1 in which the potential changes in a direction in which a pressure in a pressure chamber is reduced, a second changing component Eb2 in which the potential changes from a potential of an end of the first changing component Eb1 in a direction in which the pressure in the pressure chamber is increased, and a third changing component Eb3 in which the potential changes from a potential of an end of the second changing component Eb2 in a direction in which the pressure in the pressure chamber is reduced (the pressure is reduced, increased, and then reduced).

In a case of sufficiently stirring liquid using a slight vibration on the basis of the techniques disclosed in JP-A-2002-113858 and JP-A-2005-280199, the amplitude of a slight-vibration pulse needs to be increased. However, in a case in which the amplitude of the slight-vibration pulse shown in FIG. 10 or FIG. 11 is increased, there is a high probability that liquid will be accidentally ejected from a nozzle because the pressure in the pressure chamber is excessively increased when the second changing component (Ea3 or Eb2) is supplied to a pressure generating element.

SUMMARY

An advantage of some aspects of the invention is to sufficiently stir liquid using a slight vibration while effectively preventing accidental ejection.

An aspect of the invention will be described. Note that, in order to facilitate understanding of the invention, correspondences between elements of the invention and elements of embodiments described below will be denoted in parenthesis, but the scope of the invention is not limited to the embodiments.

A liquid ejecting apparatus (for example, a printing apparatus 100) according to an aspect of the invention includes a liquid discharging unit (for example, a recording head 22) that ejects liquid contained in a pressure chamber (for example, a pressure chamber 50) from a nozzle by varying a pressure in the pressure chamber using a pressure generator (for example, a piezoelectric vibrator 422), and a drive-signal generating unit (for example, a drive-signal generator 64) that generates a drive signal (for example, a drive signal COM) used to cause the pressure generator to operate. The drive signal includes a slight-vibration pulse (for example, a slight-vibration pulse PS) used to change the pressure in the pressure chamber to an extent that the liquid is not ejected from the nozzle. The slight-vibration pulse includes a first changing component (for example, a first changing component Wv1) in which a potential changes from a reference potential (for example, a reference potential VREF) in a first direction in which the pressure in the pressure chamber is increased by the pressure generator, a second changing component (for example, a second changing component Wv2) which is generated so as to follow the first changing component and in which the potential changes so as to cross the reference potential in a second direction opposite to the first direction, and a third changing component (for example, a third changing component Wv3) which is generated so as to follow the second changing component and in which the potential changes to the reference potential in the first direction.

In the above configuration, after the pressure in the pressure chamber is increased using the first changing component, the pressure in the pressure chamber is reduced using the second changing component. After the pressure in the pressure chamber is reduced using the second changing component, the pressure in the pressure chamber is increased using the third changing component. In other words, a process of increasing the pressure in the pressure chamber is separated into processes that are performed before and after a process of reducing the pressure in the pressure chamber is performed. With this configuration, a pressure variation in the pressure chamber caused by increasing the pressure in the pressure chamber once is reduced, compared with that in a case of using any one of the configurations (in which the pressure in the pressure chamber is increased only once by supplying a slight-vibration pulse) disclosed in JP-A-2002-113858 and JP-A-2005-280199. Consequently, accidental ejection of the liquid caused by increasing the pressure in the pressure chamber can be prevented, even in a case in which a sufficient amplitude of the slight-vibration pulse is ensured so that the liquid in the pressure chamber is sufficiently stirred.

It is preferable that the slight-vibration pulse include a first holding component (for example, a first holding component Wh1) which connects the first changing component with the second changing component and in which a potential of an end of the first changing component is held. It is preferable that, for a Helmholtz resonance period of TC in the pressure chamber, a total time (for example, a total time LA) which is a sum of a time length (for example, a time length Th1) of the first holding component and a time length (for example, a time length Tv2) of the second changing component be set to be equal to or longer than 3TC/4 and equal to or shorter than 5TC/4. In this aspect, because the total time that is a sum of the time length of the first holding component and the time length of the second changing component is set to be equal to or longer than 3TC/4 and equal to or shorter than 5TC/4, a pressure variation (for example, a pressure variation X1) generated in the pressure chamber by supplying the first changing component is immediately reduced by supplying the second changing component. Consequently, malfunctions caused by continuation of a pressure variation in the pressure chamber (for example, accidental ejection of the liquid, pulling of air bubbles into the pressure chamber, and an error in an amount of ejected liquid) can be prevented. It is preferable that the total time which is a sum of the time length of the first holding component and the time length of the second changing component be set to be equal to or longer than 7TC/8 and equal to or shorter than 9TC/8, so that an effect of reducing the pressure variation caused by the first changing component by supplying the second changing component becomes further prominent. It is preferable that the total time which is a sum of the time length of the first holding component and the time length of the second changing component be set to be TC, so that the effect becomes very prominent.

It is preferable that the slight-vibration pulse include a second holding component (for example, a second holding component Wh2) which connects the second changing component with the third changing component and in which a potential of an end of the second changing component is held. It is preferable that, for the Helmholtz resonance period of TC in the pressure chamber, the total time (for example, a total time LB) which is a sum of a time length (for example, a time length Th2) of the second holding component and a time length (for example, a time length Tv3) of the third changing component be set to be equal to or longer than 3TC/4 and equal to or shorter than 5TC/4. In this aspect, because the total time that is a sum of the time length of the second holding component and the time length of the third changing component is set to be equal to or longer than 3TC/4 and equal to or shorter than 5TC/4, a pressure variation (for example, a pressure variation X12) generated in the pressure chamber by supplying the second changing component is immediately reduced by supplying the third changing component. Consequently, malfunctions caused by continuation of a pressure variation in the pressure chamber (for example, accidental ejection of the liquid, pulling of air bubbles into the pressure chamber, and an error in amount of ejected liquid) can be prevented. It is preferable that the total time which is a sum of the time length of the second holding component and the time length of the third changing component be set to be equal to or longer than 7TC/8 and equal to or shorter than 9TC/8, so that an effect of reducing the pressure variation caused by the second changing component by supplying the third changing component becomes further prominent. It is preferable that the total time which is a sum of the time length of the second holding component and the time length of the third changing component be set to be TC, so that the effect becomes very prominent.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
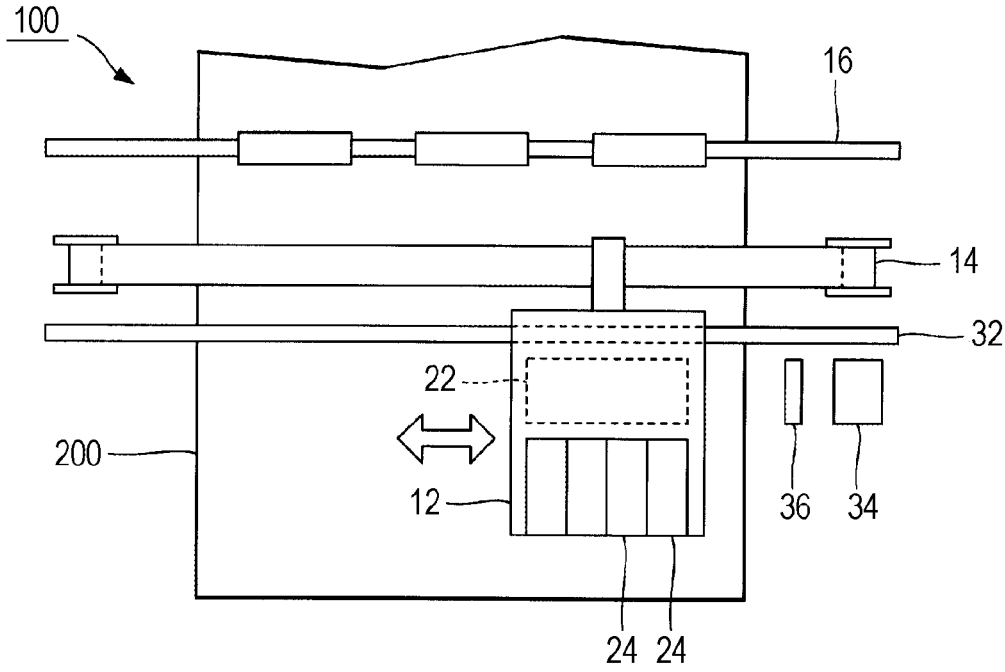
FIG. 1 is a partial schematic view of a printing apparatus according to a first embodiment of the invention.

FIG. 1 is a partial schematic view of an ink-jet printing apparatus 100 according to a first embodiment of the invention. The printing apparatus 100 is a liquid ejecting apparatus that ejects tiny ink droplets onto a recording sheet 200, and is configured so as to include a carriage 12, a moving mechanism 14, and a sheet transporting mechanism 16. A recording head 22 that functions as a liquid discharging unit is placed in the carriage 12, and ink cartridges 24 that store ink to be supplied to the recording head 22 are mounted so as to be detachably attached. Alternatively, a configuration may be employed in which the ink cartridges 24 are fixed to a housing (not shown) of the printing apparatus 100 so as to supply ink to the recording head 22.

The moving mechanism 14 causes the carriage 12 to reciprocate along a guide shaft 32 in the main scanning direction (the width direction of the recording sheet 200, as indicated by the arrow in FIG. 1). The position of the carriage 12 is detected by a detector (not shown), such as a linear encoder, and used for controlling the moving mechanism 14. The sheet transporting mechanism 16 transports the recording sheet 200 in the sub-scanning direction at the same time that the carriage 12 reciprocates. When the carriage 12 reciprocates, the recording head 22 ejects ink onto the recording sheet 200, whereby a desired image is recorded (printed) on the recording sheet 200. In addition, a cap 34 seals a nozzle formation surface of the recording head 22 and a wiper 36 that wipes off the nozzle formation surface are placed near an end of a path along which the carriage 12 reciprocates.

Figure 2:
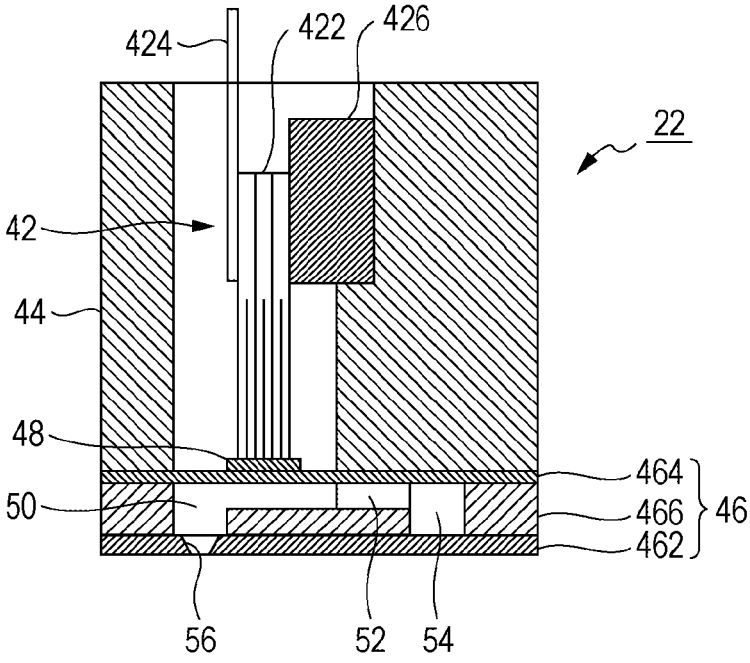
FIG. 2 is a cross-sectional view of a recording head.

FIG. 2 is a cross-sectional view (a section perpendicular to the main scanning direction) of the recording head 22. As shown in FIG. 2, the recording head 22 includes vibration units 42, an accommodator 44, and a flow-path unit 46. Each of the vibration units 42 is configured so as to include a piezoelectric vibrator 422, a cable 424, and a fixing plate 426. The piezoelectric vibrator 422 is a vertical vibrating piezoelectric element in which a piezoelectric material and an electrode are alternately stacked, and is vibrated in accordance with a drive signal that is supplied via the cable 424. The vibration unit 42 is accommodated in the accommodator 44 in a state in which the fixing plate 426 with the piezoelectric vibrators 422 fixed thereto is bonded to an inner wall surface of the accommodator 44.

The flow-path unit 46 has a structure in which a flow-path forming plate 466 is inserted into a gap between substrates 462 and 464 that face each other. The flow-path forming plate 466 forms a space including a pressure chamber 50, supply paths 52, and storage chambers 54 in the gap between the substrates 462 and 464. The pressure chamber 50 is divided into portions by partitions on a vibration-unit-42-by-vibration-unit-42 basis, and communicates with the storage chambers 54 through the supply paths 52. A plurality of nozzles (discharging outlets) 56 corresponding to the individual portions of the pressure chamber 50 are formed in columns on the substrate 462. Each of the nozzles 56 is a through-hole that causes the pressure chamber 50 to communicate with the outside. Ink supplied from each of the ink cartridges 24 is stored in a corresponding one of the storage chambers 54. As will be understood from the above description, a flow path of ink is formed, along which ink flows from the corresponding storage chamber 54 to the outside through the corresponding supply path 52, the pressure chamber 50, and the corresponding nozzle 56.

The substrate 464 is a flat plate formed of an elastic material. Island-shaped vibration plates 48 are provided in a region of the substrate 464 on a side opposite to the pressure chamber 50. The tip surface (free end) of each of the piezoelectric vibrators 422 is bonded to a corresponding one of the vibration plates 48. Consequently, when the piezoelectric vibrator 422 is vibrated by supplying a drive signal, the volume of the pressure chamber 50 is changed by displacing the substrate 464 via the vibration plate 48, whereby the pressure applied to ink contained in the pressure chamber 50 is varied. In other words, the piezoelectric vibrator 422 functions as a pressure generator that varies the pressure in the pressure chamber 50. Thus, ink can be ejected from the nozzle 56 in accordance with a pressure variation in the pressure chamber 50, which is described above.

Figure 3:
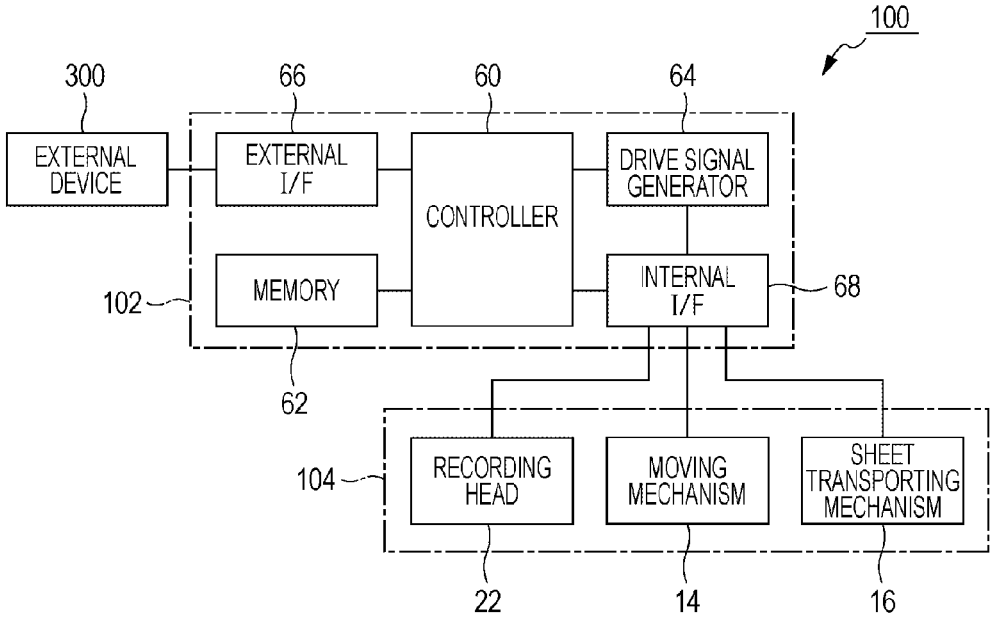
FIG. 3 is a block diagram showing an electrical configuration of the printing apparatus.

FIG. 3 is a block diagram showing an electrical configuration of a printing apparatus 100. As shown in FIG. 3, the printing apparatus 100 includes a control device 102 and a print processing section (a print engine) 104. The control device 102 is a component that performs overall control of the printing apparatus 100, and is configured so as to include a controller 60, a storage unit 62, a drive-signal generator 64, an external interface (I/F) 66, and an internal interface 68. Print data representing an image to be printed on the recording sheet 200 is supplied from an external device (for example, a host computer) 300 to the external I/F 66. The print processing section 104 is connected to the internal I/F 68. The print processing section 104 is a component that records an image onto the recording sheet 200 under the control of the control device 102, and is configured so as to include the recording head 22, the moving mechanism 14, and the sheet transporting mechanism 16, which are described above.

The storage unit 62 is configured so as to include a read-only memory (ROM) that stores a control program and so forth, and a random-access memory (RAM) that temporarily stores various data necessary for printing an image (for discharging ink on a nozzle-56-by-nozzle-56 basis). The controller 60 integrally controls each component included in the printing apparatus 100 (for example, the moving mechanism 14 and the sheet transporting mechanism 16 of the print processing section 104) by executing the control program stored in the storage unit 62. In addition, the controller 60 converts print data supplied from the external device 300 to the external I/F 66 into ejection data D for instructing ejection/non-ejection of ink from the individual nozzles 56 of the recording head 22 on a piezoelectric-vibrator-422-by-piezoelectric-vibrator-422 basis.

Figure 4:
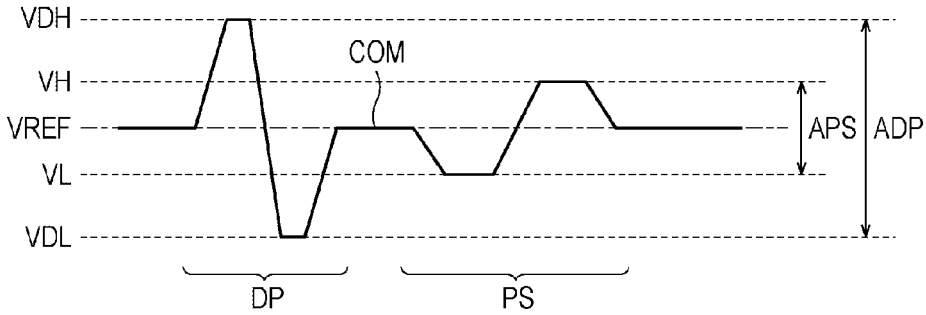
FIG. 4 is a waveform diagram of a drive signal.

The drive-signal generator 64 generates a drive signal COM. The drive signal COM is a periodic signal for driving the individual piezoelectric vibrators 422. As shown in FIG. 4, in a time period corresponding to a single period (a recording period) of the drive signal COM, an ejection pulse DP and a slight-vibration pulse PS are set. The ejection pulse DP is a drive pulse for, when being supplied to each of the piezoelectric vibrators 422, vibrating the pressure chamber 50 so that a predetermined amount of ink is ejected from a corresponding one of the nozzles 56. The ejection pulse DP is shaped into a waveform in which the potential varies between a potential VDH and a potential VDL. More specifically, the ejection pulse DP is formed so as to include a waveform portion in which the potential increases from a predetermined reference potential VREF to the potential VDH that is on a high potential side, a waveform portion in which the potential decreases from the potential VDH through the reference potential VREF to the potential VDL that is on a low potential side, and a waveform portion in which the potential increases from the potential VDL to the reference potential VREF.

In contrast, the slight-vibration pulse PS is a drive pulse used to change the pressure in the pressure chamber 50 to an extent that, when being supplied to each of the piezoelectric vibrators 422, ink contained in the pressure chamber 50 is not ejected from a corresponding one of the nozzles 56. The slight-vibration pulse PS is shaped into a waveform in which the potential varies between a potential VH and a potential VL. The ink contained in the pressure chamber 50 is stirred by supplying the slight-vibration pulse PS to the piezoelectric vibrator 422. Accordingly, an increase in the viscosity of the ink contained in the pressure chamber 50 is reduced. As shown in FIG. 4, the potential VH which is on a high potential side of the slight-vibration pulse PS is lower than the potential VDH of the ejection pulse DP, and the potential VL which is on a low potential side of the slight-vibration pulse PS is higher than the potential VDL of the ejection pulse DP. In other words, a potential amplitude APS (hereinafter, referred to as a "potential change amount APS" in some cases) (APS=VH−VL) of the slight-vibration pulse PS is smaller than a potential amplitude ADP (hereinafter, referred to as a "potential change amount ADP" in some cases) (ADP=VDH−VDL) of the ejection pulse DP. For example, the potential amplitude APS of the slight-vibration pulse PS is set to about 7.0 V (volts).

Figure 5:
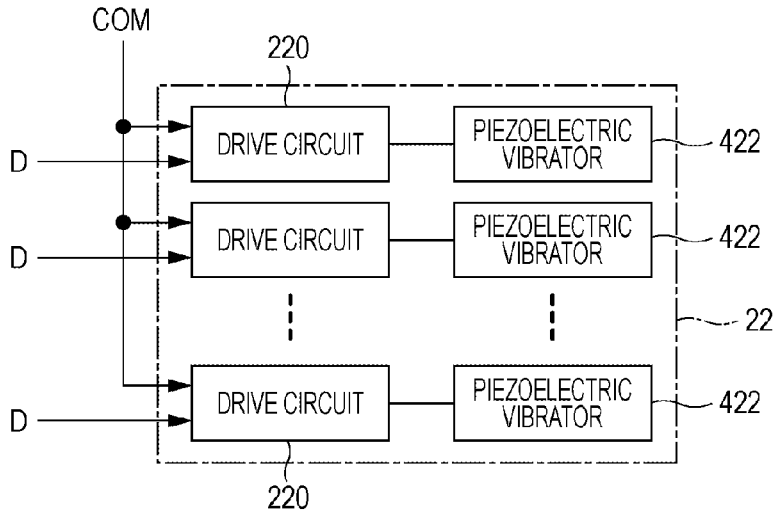
FIG. 5 is a block diagram showing an electrical configuration of the recording head.

FIG. 5 is a schematic view showing an electrical configuration of the recording head 22. As shown in FIG. 5, the recording head 22 is configured so as to include a plurality of drive circuits 220 corresponding to the individual nozzles 56 (the piezoelectric vibrators 422) that are different from each other. The drive signal COM generated by the drive-signal generator 64 is supplied as a common signal to the plurality of drive circuits 220 through the internal I/F 68. Furthermore, the ejection data D generated by the controller 60 is also supplied to the individual drive circuits 220 through the internal I/F 68.

Each of the drive circuits 220 selects a drive pulse from the drive signal COM in accordance with the ejection data D, and supplies the selected drive pulse to a corresponding one of the piezoelectric vibrators 422. More specifically, when the ejection data D is used to instruct ejection of ink, the drive circuit 220 selects the ejection pulse DP of the drive signal COM, and supplies the ejection pulse DP to the piezoelectric vibrator 422. Consequently, ink contained in the pressure chamber 50 is ejected from the corresponding nozzle 56 onto the recording sheet 200. In contrast, when the ejection data D is used to instruct non-ejection of ink (stop of ejection), the drive circuit 220 selects the slight-vibration pulse PS of the drive signal COM, and supplies the slight-vibration pulse PS to the piezoelectric vibrator 422. Consequently, the ink contained in the pressure chamber 50 is appropriately stirred without being ejected.

Figure 6:
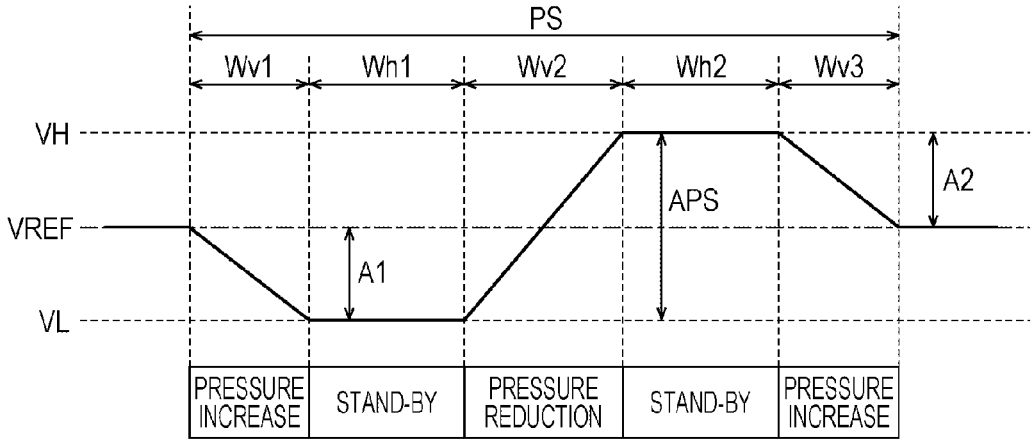
FIG. 6 is a waveform diagram of a slight-vibration pulse.

FIG. 6 is a waveform diagram of the slight-vibration pulse PS of the drive signal COM. The vertical axis in the FIG. 6 indicates potential, and the horizontal axis indicates time. As shown in FIG. 6, the slight-vibration pulse PS has a waveform in which a first changing component Wv1, a first holding component Wh1, a second changing component Wv2, a second holding component Wh2, and a third changing component Wv3 are connected to each other in this order. A time length of the of each of the first changing component Wv1 and the third changing component Wv3 is set to, for example, about 4.0 μs. A time length of the second changing component Wv2 is set to, for example, about 4.5 μs. Additionally, a time length of each of the first holding component Wh1 and the second holding component Wh2 is set to, for example, about 4.5 μs.

The first changing component Wv1 is a waveform portion in which the potential varies with a predetermined gradient from the predetermined reference potential VREF to the potential VL in a negative direction (the direction in which the potential decreases). When the first changing component Wv1 is supplied, the piezoelectric vibrator 422 increases the pressure in the pressure chamber 50. In other words, the vibration plate 48 (the tip portion of the piezoelectric vibrator 422) is displaced so that the pressure chamber 50 is shrunk.

The first holding component Wh1 is a waveform portion that follows the first changing component Wv1, and that connects the first changing component Wv1 with the second changing component Wv2. In the first holding component Wh1, the potential VL of an end of the first changing component Wv1 is held. Accordingly, the operation of the piezoelectric vibrator 422 (displacing the vibration plate 48) stops in a state in which the pressure in the pressure chamber 50 is held so as to be a pressure corresponding to the end of the first changing component Wv1. In FIG. 6, the state in which a vibration of the piezoelectric vibrator 422 has stopped is denoted by "stand-by".

The second changing component Wv2 is a waveform portion that follows the first holding component Wh1. In the second changing component Wv2, the potential varies with a predetermined gradient from the potential VL of an end of the first holding component Wh1 (an the end of the first changing component Wv1) to the potential VH in a positive direction (the direction in which the potential increases) which is opposite to the direction in which the potential changes in the first changing component Wv1. When the second changing component Wv2 is supplied, the piezoelectric vibrator 422 reduces the pressure in the pressure chamber 50. In other words, the vibration plate 48 is displaced so that the pressure chamber 50 is expanded.

The potential change amount APS of the second changing component Wv2 is larger than a potential change amount A1 (A1=VREF−VL) of the first changing component Wv1. Consequently, in the second changing component Wv2, the potential varies so as to cross the reference potential VREF. More specifically, the potential change amount A1 of the first changing component Wv1 is set to about half the potential change amount APS of the second changing component Wv2, i.e., 3.5 V.

The second holding component Wh2 is a waveform portion that follows the second changing component Wv2 and that connects the second changing component Wv2 with the third changing component Wv3. In the second holding component Wh2, the potential VH of an end of the second changing component Wv2 is held. Accordingly, the operation of the piezoelectric vibrator 422 stops in a state in which the pressure in the pressure chamber 50 is held so as to be a pressure corresponding to the end of the second changing component Wv2.

The third changing component Wv3 is a waveform portion that follows the second holding component Wh2. In the third changing component Wv3, the potential varies with a predetermined gradient from the potential VH of an end of the second holding component Wh2 (an end of the second changing component Wv2) to the reference potential VREF in the negative direction that is opposite to the direction in which the potential changes in the second changing component Wv2. When the third changing component Wv3 is supplied, the piezoelectric vibrator 422 increases the pressure in the pressure chamber 50. In other words, the vibration plate 48 is displaced so that the pressure chamber 50 is shrunk.

The potential change amount A2 (A2=VH−VREF) of the third changing component Wv3 is smaller than the potential change amount APS of the second changing component Wv2. More specifically, the potential change amount A2 of the third changing component Wv3 is set to the difference (A2=APS−A1) between the potential change amount APS of the second changing component Wv2 and the potential change amount A1 of the first changing component Wv1, i.e., 3.5 V.

Figure 10:
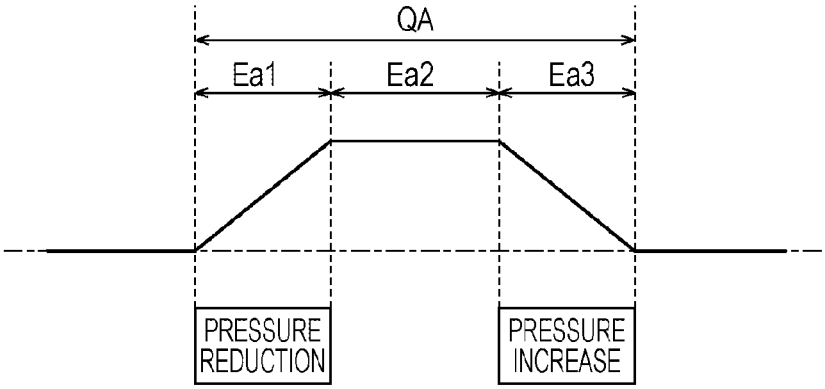
FIG. 10 is a waveform diagram of a slight-vibration pulse disclosed in JP-A-2002-113858.
Figure 11:
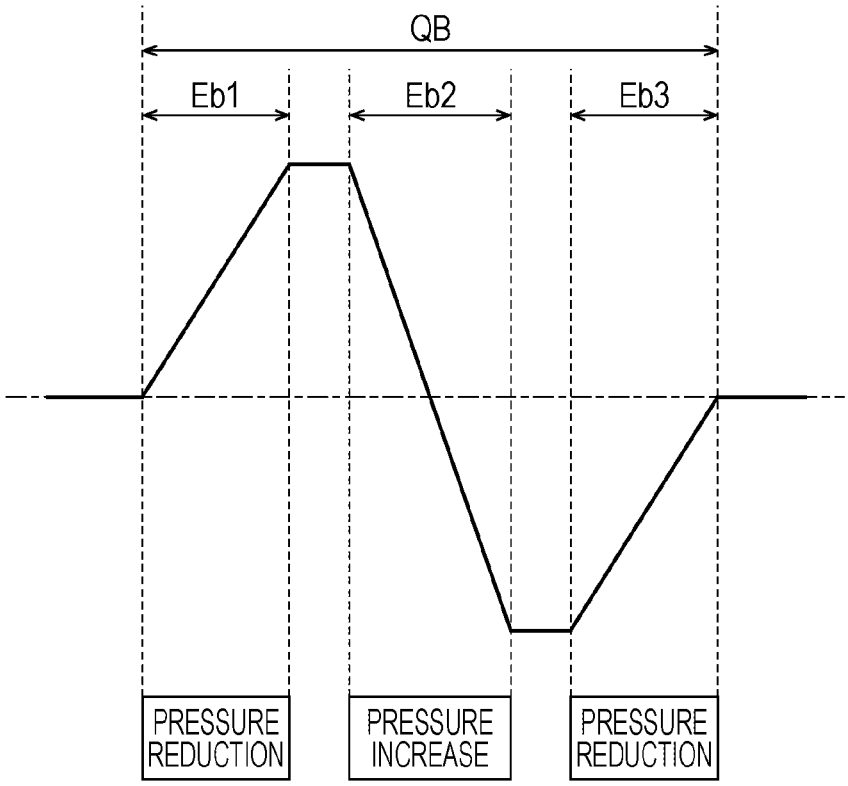
FIG. 11 is a waveform diagram of a slight-vibration pulse disclosed in JP-A-2005-280199.

As described above, in the first embodiment, the pressure in the pressure chamber 50 is increased using the first changing component Wv1, and, then, the pressure in the pressure chamber 50 is reduced using the second changing component Wv2. The pressure in the pressure chamber 50 is reduced using the second changing component Wv2, and, then, the pressure in the pressure chamber 50 is increased using the third changing component Wv3 (the pressure is increased, reduced, and then increased). In other words, a process of increasing the pressure in the pressure chamber 50 is separated into processes that are performed before and after a process of reducing the pressure in the pressure chamber 50 is performed. With this configuration, a pressure variation in the pressure chamber 50 caused by increasing in the pressure once is reduced, compared with a pressure variation in a case in which the slight-vibration pulse QA shown in FIG. 10 or the slight-vibration pulse QB shown in FIG. 11 is used (in a case in which the pressure in the pressure chamber is increased only once by supplying the slight-vibration pulse). Consequently, there is an advantage that accidental ejection of ink caused by increasing the pressure in the pressure chamber 50 is prevented, even in a case in which a sufficient potential amplitude APS of the slight-vibration pulse PS is ensured so that the ink is effectively stirred in the pressure chamber 50.

B. Second Embodiment

A second embodiment of the invention will be described below. Components which are provided in each embodiment that is described below as an example and whose functions and effects are equivalent to the functions and effects thereof in the first embodiment are denoted by the same reference numerals used in the above description, and a detailed description thereof will be omitted as appropriate.

When the pressure in the pressure chamber 50 is increased by supplying the first changing component Wv1, a periodic pressure variation in the pressure chamber 50 continues even after a vibration of the piezoelectric vibrator 422 (the vibration plate 48) has been stopped by supplying the first holding component Wh1. However, if the pressure variation in the pressure chamber 50 continues for a long time period, there is a high probability that, because of an influence of, for example, interference with a vibration generated from another portion of the pressure chamber 50, the pressure in the pressure chamber 50 is excessively increased, resulting in accidental ejection of ink, or the pressure in the pressure chamber 50 is excessively reduced, resulting in pulling of air bubbles from the nozzle 56 into the pressure chamber 50.

Even in a case in which neither accidental ejection of ink nor pulling of air bubbles occurs, there is a high probability that an error in the amount of ejected ink (a difference from a target value) is generated because the pressure variation in the pressure chamber 50 continues until ink is next ejected. Consequently, it is desired that the pressure variation in the pressure chamber 50 caused by supplying the first changing component Wv1 be immediately reduced after supply of the first changing component Wv1 has finished. The same thing is also true for a periodic pressure variation in the pressure chamber 50 caused by supplying the second changing component Wv2. It is desired that the pressure variation be immediately reduced after supply of the second changing component Wv2 has finished.

In view of the foregoing circumstances, in the second embodiment, a waveform of the slight-vibration pulse PS (the time length of each component) is set so that the pressure variation in the pressure chamber 50 generated by supplying the first changing component Wv1 is reduced (canceled) by supplying the second changing component Wv2, and the pressure variation in the pressure chamber 50 generated by supplying the second changing component Wv2 is reduced by supplying the third changing component Wv3.

Figure 7A:
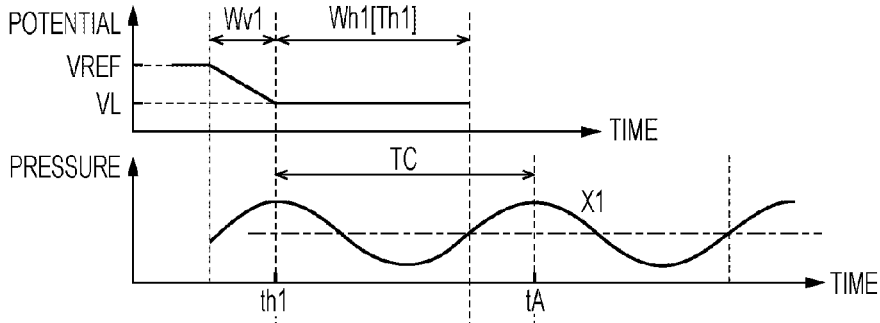
FIGS. 7A to 7D are explanatory diagrams showing a time length of a first holding component in a second embodiment.
Figure 7B:
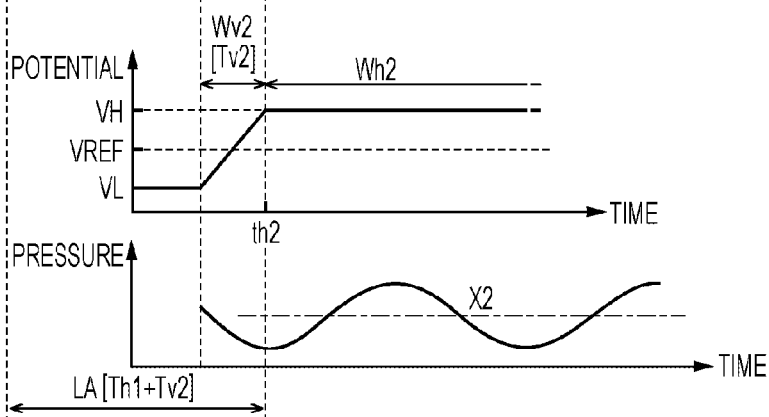

FIG. 7A shows a pressure variation in the pressure chamber 50 in a case in which the first changing component Wv1 and the first holding component Wh1 are alone supplied to the piezoelectric vibrator 422 (without supplying the other components of the slight-vibration pulse PS). FIG. 7B shows a pressure variation in the pressure chamber 50 in a case in which it is supposed that the second changing component Wv2 and the second holding component Wh2 are alone supplied to the piezoelectric vibrator 422 which is in a static state.

As shown in FIG. 7A, when the pressure in the pressure chamber 50 is forcibly increased using a vibration of the piezoelectric vibrator 422 generated by supplying the first changing component Wv1, a periodic pressure variation (free vibration) X1 remains in the pressure chamber 50 even after the vibration of the piezoelectric vibrator 422 is stopped at a starting point th1 of the first holding component Wh1 (the end point of the first changing component Wv1). As will be understood from FIG. 7A, the pressure variation X1 caused by supplying the first changing component Wv1 is approximated by a vibration which has a local maximum point (antinode of the vibration) at the starting point th1 of the first holding component Wh1 and which has a period of TC. The period of TC corresponds to a natural vibration period of Helmholtz resonance (a natural period of the entire vibration system including the recording head 22, ink, etc.) in the pressure chamber 50, and is, for example, about 7.0 μs.

In contrast, as shown in FIG. 7B, when the pressure in the pressure chamber 50 is forcibly reduced using a vibration of the piezoelectric vibrator 422 generated by supplying the second changing component Wv2, a pressure variation X2 which has a local minimum point at a starting point th2 of the second holding component Wh2 (the end point of the second changing component Wv2) and which has a period of TC is generated in the pressure chamber 50. In view of the foregoing circumstances, in the second embodiment, the starting point th2 of the second holding component Wh2 is set in accordance with the period of TC of the pressure variation X1 so that the pressure variation X1 caused by the first changing component Wv1 is reduced (canceled) by the pressure variation X2 caused by the second changing component Wv2.

More specifically, as will be understood from FIGS. 7A and 7B, at a time point tA, the intensity of the pressure variation X1 caused by the first changing component Wv1 is first maximized after supply of the first holding component Wh1 starts, and, at a time point th2, the intensity of the pressure variation X2 caused by the second changing component Wv2 is first minimized. When the time point tA and the time point th2 coincide with each other, an effect of reducing the pressure variation X1 becomes prominent. The time point tA at which the pressure variation X1 maximized is a time point at which the period of TC elapses from the starting point th1 of the first holding component Wh1. The time point th2 at which the intensity of the pressure variation X2 is minimized is a time point at which a time period corresponding to the period of the first holding component Wh1 and the period of the second changing component Wv2 elapses from the starting point th1 of the first holding component Wh1. Thus, in the second embodiment, the total time LA that is a sum of a time length Th1 of the first holding component Wh1 and a time length Tv2 of the second changing component Wv2 is set so that the time point th2 at which the pressure variation X2 is minimized is located within a predetermined range (Ra1 or Ra2) that includes the time point tA.

Figure 7C:
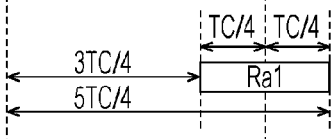
Figure 7D:
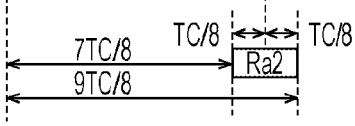

For example, as shown in FIG. 7C, the total time LA that is a sum of the time length Th1 of the first holding component Wh1 and the time length Tv2 of the second changing component Wv2 is set to be equal to or longer than 3TC/4 (=TC−TC/4) and equal to or shorter than 5TC/4 (=TC+TC/4) so that the starting point th2 of the second holding component Wh2 (i.e., the local minimum point of the pressure variation X2) is located within the range Ra1 which includes a time period of TC/4 before the time point tA and a time period of TC/4 after the time point tA. More preferably, as shown in FIG. 7D, the total time LA that is a sum of the time length Th1 of the first holding component Wh1 and the time length Tv2 of the second changing component Wv2 is set to be equal to or longer than 7TC/8 (=TC−TC/8) and equal to or shorter than 9TC/8 (=TC+TC/8) so that the starting point th2 of the second holding component Wh2 is located within the range Ra2 which includes a time period of TC/8 before the time point tA and a time period of TC/8 after the time point tA. More specifically, the total time LA that is a sum of the time length Th1 of the first holding component Wh1 and the time length Tv2 of the second changing component Wv2 is set to be TC so that the starting point th2 of the second holding component Wh2 coincides with the time point tA.

With the above-described configuration, the pressure variation X1 that is generated in the pressure chamber 50 by supplying the first changing component Wv1 is immediately reduced by supplying the second changing component Wv2. Thus, the foregoing problems caused by continuation of the pressure variation X1 (accidental ejection of ink, pulling of air bubbles into the pressure chamber 50, and an error in an amount of ejected ink) can be prevented.

Figure 8A:
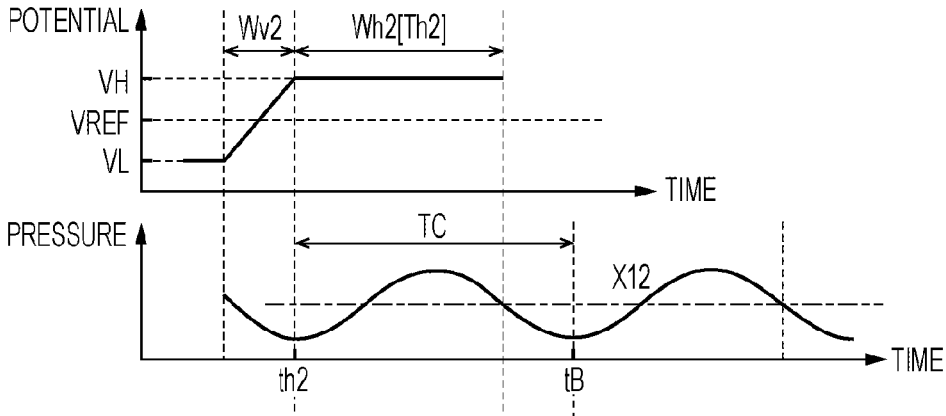
FIGS. 8A to 8D are explanatory diagrams showing a time length of a second holding component in the second embodiment.

In contrast, the potential change amount APS of the second changing component Wv2 is larger than the potential change amount A1 of the first changing component Wv1. Accordingly, the amplitude of the pressure variation generated using the second changing component Wv2 is higher than the amplitude of the pressure variation generated using the first changing component Wv1. Consequently, as shown in FIG. 8A, a pressure variation X12 corresponding to the difference between the pressure variation X2, which is caused by the second changing component Wv2, and the pressure variation X1, which is caused by the first changing component Wv1, remains in the pressure chamber 50 even after a vibration of the piezoelectric vibrator 422 is stopped at the starting point th2 of the second holding component Wh2 (the end point of the second changing component Wv2). As will be understood from FIG. 8A, the pressure variation X12 caused by the second changing component Wv2 is approximated by a vibration which has a local minimum point at the starting point th2 of the second holding component Wh2 and which has a period of TC (a Helmholtz resonance period).

Figure 8B:
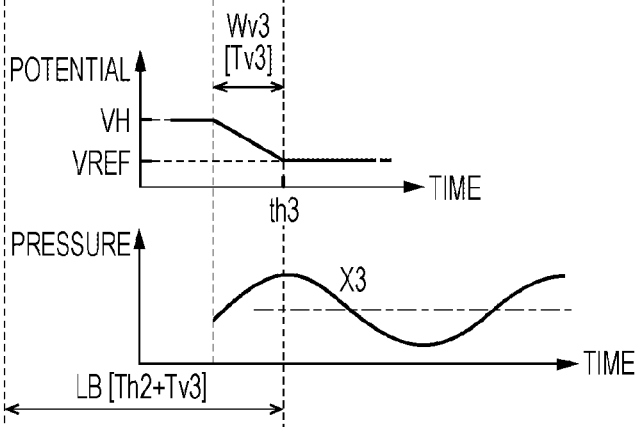

In contrast, FIG. 8B shows a pressure variation in the pressure chamber 50 in a case in which it is supposed that the third changing component Wv3 is alone supplied to the piezoelectric vibrator 422 that is in a static state. As shown in FIG. 8B, when the pressure in the pressure chamber 50 is forcibly increased using a vibration of the piezoelectric vibrator 422 generated by supplying the third changing component Wv3, a pressure variation X3 which has a local maximum point at an end point th3 of the third changing component Wv3 and which has a period of TC is generated in the pressure chamber 50. In view of the foregoing circumstances, in the second embodiment, the end point th3 of the third changing component Wv3 is set in accordance with the period of TC of the pressure variation X12 so that the pressure variation X12 caused by the first changing component Wv1 and the second changing component Wv2 is reduced (canceled) by the pressure variation X3 caused by the third changing component Wv3.

More particularly, as will be understood from FIGS. 8A and 8B, at a time point tB, the intensity of the pressure variation X12 is first minimized after supply of the second holding component Wh2 starts, and, at the time point th3, the intensity of the pressure variation X2 caused by the third changing component Wv3 is first maximized. When the time point tB and the time point th3 coincide with each other, an effect of reducing the pressure variation X12 becomes prominent. The time point tB at which the pressure variation X12 is minimized is a time point at which the period of TC elapses from the starting point th2 of the second holding component Wh2. The time point th3 at which the intensity of the pressure variation X3 is maximized is a time point at which a time period corresponding to the period of the second holding component Wh2 and the period of the third changing component Wv3 elapses from the starting point th2 of the second holding component Wh2. Thus, in the second embodiment, a total time LB that is a sum of a time length Th2 of the second holding component Wh2 and a time length Tv3 of the third changing component Wv3 is set so that the time point th3 at which the pressure variation X3 is maximized is located within a predetermined range (Rb1 or Rb2) that includes the time point tB.

Figure 8C:
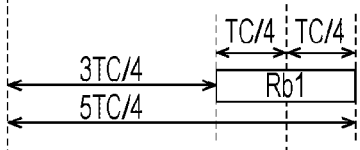
Figure 8D:
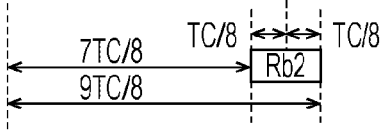

For example, as shown in FIG. 8C, the total time LB that is a sum of the time length Th2 of the second holding component Wh2 and the time length Tv3 of the third changing component Wv3 is set to be equal to or longer than 3TC/4 (=TC−TC/4) and equal to or shorter than 5TC/4 (=TC+TC/4) so that the end point th3 of the third changing component Wv3 (i.e., the local maximum point at which the pressure variation X3 is maximized) is located within the range Rb1 which includes a time period of TC/4 before the time point tB and a time period of TC/4 after the time point tB. More preferably, as shown in FIG. 8D, the total time LB that is a sum of the time length Th2 of the second holding component Wh2 and the time length Tv3 of the third changing component Wv3 is set to be equal to or longer than 7TC/8 (=TC−TC/8) and equal to or shorter than 9TC/8 (=TC+TC/8) so that the end point th3 of the third changing component Wv3 is located within the range Rb2 which includes a time period of TC/8 before the time point tB and a time period of TC/8 after the time point tB. More specifically, the total time LB that is a sum of the time length Th2 of the second holding component Wh2 and the time length Tv3 of the third changing component Wv3 is set to be TC so that the end point th3 of the third changing component Wv3 coincides with the time point tB.

With the above-described configuration, the pressure variation X12 that is generated in the pressure chamber 50 by supplying the first changing component Wv1 and the second changing component Wv2 is immediately reduced by supplying the third changing component Wv3. Thus, the foregoing problems caused by continuation of the pressure variation X12 (accidental ejection of ink, pulling of air bubbles into the pressure chamber 50, and an error in an amount of ejected ink) can be prevented.

Note that, although any value can be used as the specific time length of each component of the slight-vibration pulse PS, Examples 1 and 2 given below may be employed. Note that the time length Tv1 is a time length of the first changing component Wv1. Note that the Helmholtz resonance period of TC is 7.0 μs, as mentioned above.

Example 1: Tv1=Th1=Tv2=Th2=Tv3=3.5 [μs]

Example 2: Tv1=Tv3=Th1=Th2=4.0 [μs], Tv2=4.5 [μs]

In Example 1, each of the total time LA (=Th1+Tv2) and the total time LB (=Th2+Tv3) coincides with the Helmholtz resonance period of TC (LA=LB=7.0 [μs]). Accordingly, the effect of immediately reducing a pressure variation in the pressure chamber 50 becomes very prominent. In Example 2, a value in the range Ra1 shown in FIG. 7C is used as the total time LA (LA=8.5), and a value in the range Rb1 shown in FIG. 8C (LB=8.0) is used as the total time duration LB. Accordingly, the effect of immediately reducing a pressure variation in the pressure chamber 50 is assuredly realized.

C. Modification Examples

The embodiments described above can be variously modified. Specific modification examples are provided below. Any two or more modification examples selected from the modification examples provided below may be combined as appropriate.

1. First Modification Example

Figure 9:
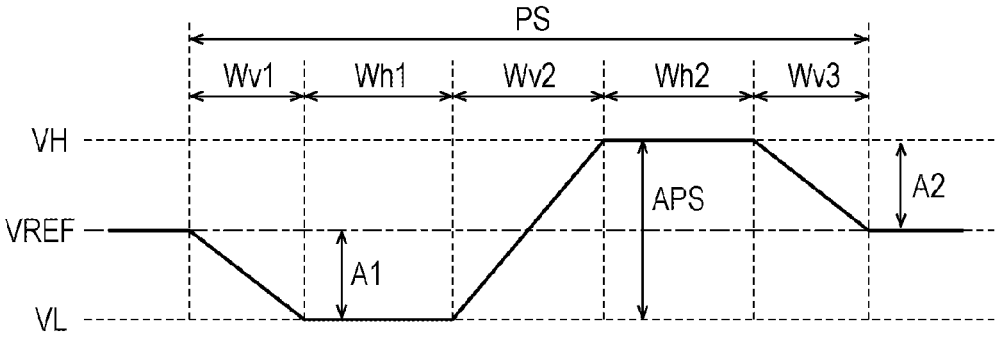
FIG. 9 is a waveform diagram of a slight-vibration pulse in a modification example.

The waveform of the slight-vibration pulse PS is modified appropriately. For example, in each of the embodiments described above, the case is provided as an example, in which the respective time lengths and the respective potential change amounts (A1 and A2) of the first changing component Wv1 and the third changing component Wv3 are equal to each other. However, as shown in FIG. 9, for example, a configuration may also be employed, in which the respective time lengths and the respective potential change amounts of the first changing component Wv1 and the third changing component Wv3 are different from each other. However, a configuration is preferably employed, in which potential change amounts of the individual components are set so that the potential of the slight-vibration pulse PS starts with the reference potential VREF and ends with the reference potential VREF and the sum of the potential change amount A1 of the first changing component Wv1 and the potential change amount A2 of the third changing component Wv3 is equal to the potential change amount APS of the second changing component Wv2. In addition, the first holding component Wh1 or the second holding component Wh2 in each of the above-described embodiments may be omitted.

2. Second Modification Example

In each of the embodiments described above, the piezoelectric vibrator 422 is caused to operate so that the pressure in the pressure chamber 50 is increased by supplying a negative-polarity potential with respect to the reference potential VREF and the pressure in the pressure chamber 50 is reduced by supplying a positive-polarity potential. However, the relationship between polarities of potentials supplied to the piezoelectric vibrator 422 and increase/reduction of the pressure may be reversed. For example, in a configuration in which the pressure in the pressure chamber 50 is reduced by supplying a negative-polarity potential and in which the pressure in the pressure chamber 50 is increased by supplying a positive-polarity potential, a slight-vibration pulse having a waveform which is obtained by inverting the level of the potential of the slight-vibration pulse PS shown in FIG. 6 (i.e., a waveform in which the potential increases in each of the first changing component Wv1 and the third changing component Wv3, and the potential decreases in the second changing component Wv2) is utilized to drive the piezoelectric vibrator 422. A method similar to the method used in the second embodiment is used to set the time length Th1 of the first holding component Wh1 and the time length Th2 of the second holding component Wh2.

3. Third Modification Example

In each of the embodiments described above, a single type of drive signal COM is supplied to the recording head 22. However, a configuration may be employed, in which multiple types of drive signals in which pulses different from each other are set are supplied to the recording head 22, and in which the multiple types of drive signals are used to drive the individual piezoelectric vibrators 422. The slight-vibration pulse PS described in each of the above-described embodiments is set in one or more types of drive signals among the multiple types of drive signals COM. In addition, any shape may be used as the shape of the ejection pulse DP in each of the drive signals.

4. Fourth Modification Example

In each of the embodiments described above, the vertical vibrating piezoelectric vibrators 422 are provided as examples. However, a configuration of components (pressure generators) that change the pressure in the pressure chamber 50 is not limited thereto. For example, vibrating bodies, such as piezoelectric vibrators of a deflection vibration type or static actuators, can be utilized. In addition, the pressure generators according to the invention are not limited to components that provide mechanical vibrations to the pressure chamber 50. For example, heating elements (heaters), which generate air bubbles by heating the pressure chamber 50 to change the pressure in the pressure chamber 50, can be used as the pressure generators. In other words, the pressure generators according to the invention are included in components that change the pressure in the pressure chamber 50, and a method (a piezoelectric type/a thermal type) for changing a pressure or a configuration thereof does not matter.

5. Fifth Modification Example

The printing apparatus 100 according to each of the embodiments described above can be employed in various equipment, such as a plotter, a facsimile device, and a copier. The application of the liquid ejecting apparatus according to the invention is not limited to printing of an image. For example, the liquid ejecting apparatus that ejects solutions of individual color materials can be utilized as a manufacturing apparatus that forms a color filter of a liquid crystal display device. Furthermore, the liquid ejecting apparatus that ejects a liquid conductive material can be utilized as an electrode manufacturing apparatus that forms an electrode of a display device such as an organic EL (Electroluminescence) display device or a field emission display (FED) device. In addition, the liquid ejecting apparatus that ejects a solution of a bio-organic substance can be utilized as a chip manufacturing device that manufactures a biochip.

Additionally, in each of the embodiments described above, the serial-type printing apparatus 100 in which the carriage 12 with the recording head 24 mounted thereon moves in the main scanning direction is provided as an example. However, the invention is also applicable to a printing apparatus that utilizes a line-type recording head which is configured so as to have a long shape in the main scanning direction so that a plurality of nozzles are arranged in an entire region in the width direction of a recording sheet.

The entire disclosure of Japanese Patent Application No. 2010-223579, filed Oct. 1, 2010 is expressly incorporated by reference herein.

What is claimed is:

1. A liquid ejecting apparatus comprising:

a liquid discharging unit that ejects liquid contained in a pressure chamber from a nozzle by varying a pressure in the pressure chamber using a pressure generator; and a drive-signal generating unit that generates a drive signal used to cause the pressure generator to operate;

wherein the drive signal includes a slight-vibration pulse used to change the pressure in the pressure chamber to an extent that the liquid is not ejected from the nozzle, wherein the slight-vibration pulse includes a first changing component in which a potential changes from a reference potential in a first direction in which the pressure in the pressure chamber is increased by the pressure generator, a second changing component which is generated so as to follow the first changing component and in which the potential changes so as to cross the reference potential in a second direction opposite to the first direction, and a third changing component which is generated so as to follow the second changing component and in which the potential changes to the reference potential in the first direction, wherein the slight-vibration pulse includes a first holding component which connects the first changing component with the second changing component and in which a potential of an end of the first changing component is held, and wherein, for a Helmholtz resonance period of TC in the pressure chamber, a total time that is a sum of a time length of the first holding component and a time length of the second changing component is set to be equal to or longer than 3TC/4 and equal to or shorter than 5TC/4.

2. The liquid ejecting apparatus according to claim 1, wherein the total time that is a sum of the time length of the first holding component and the time length of the second changing component is set to be equal to or longer than 7TC/8 and equal to or shorter than 9TC/8.

3. The liquid ejecting apparatus according to claim 2, wherein the total time that is a sum of the time length of the first holding component and the time length of the second changing component is set to be TC.

4. A liquid ejecting apparatus comprising:

a liquid discharging unit that ejects liquid contained in a pressure chamber from a nozzle by varying a pressure in the pressure chamber using a pressure generator; and a drive-signal generating unit that generates a drive signal used to cause the pressure generator to operate;

wherein the drive signal includes a slight-vibration pulse used to change the pressure in the pressure chamber to an extent that the liquid is not ejected from the nozzle, wherein the slight-vibration pulse includes a first changing component in which a potential changes from a reference potential in a first direction in which the pressure in the pressure chamber is increased by the pressure generator, a second changing component which is generated so as to follow the first changing component and in which the potential changes so as to cross the reference potential in a second direction opposite to the first direction, and a third changing component which is generated so as to follow the second changing component and in which the potential changes to the reference potential in the first direction, wherein the slight-vibration pulse includes a second holding component which connects the second changing component with the third changing component and in which a potential of an end of the second changing component is held, and wherein, for a Helmholtz resonance period of TC in the pressure chamber, the total time that is a sum of a time length of the second holding component and a time length of the third changing component is set to be equal to or longer than 3TC/4 and equal to or shorter than 5TC/4.

5. The liquid ejecting apparatus according to claim 4, wherein the total time that is a sum of the time length of the second holding component and the time length of the third changing component is set to be equal to or longer than 7TC/8 and equal to or shorter than 9TC/8.

6. The liquid ejecting apparatus according to claim 5, wherein the total time that is a sum of the time length of the second holding component and the time length of the third changing component is set to be TC.

* * * * *